US007971743B2

(12) United States Patent
D'Amato

(10) Patent No.: US 7,971,743 B2
(45) Date of Patent: Jul. 5, 2011

(54) COLLAPSIBLE CONTAINER

(75) Inventor: Gianfranco D'Amato, Arzano Napoli (IT)

(73) Assignee: Seda S.p.A., Arzano Napoli (IT)

( * ) Notice: Subject to any disclaimer, the term of this patent is extended or adjusted under 35 U.S.C. 154(b) by 1525 days.

(21) Appl. No.: 10/630,378

(22) Filed: Jul. 30, 2003

(65) Prior Publication Data

US 2005/0006385 A1 Jan. 13, 2005

(30) Foreign Application Priority Data

Jul. 10, 2003 (DE) ..... 203 10 623.7

(51) Int. Cl.
*B65D 1/40* (2006.01)
*B65D 3/22* (2006.01)

(52) U.S. Cl. ..... 220/62.22; 220/62; 220/662

(58) Field of Classification Search ..... 229/4.5, 229/5.81, 5.82, 5.83, 8.84; 220/62.22, 662, 220/665, 793, 62, 592.17, 739; 222/107
See application file for complete search history.

(56) References Cited

U.S. PATENT DOCUMENTS 2,157,054 A * 5/1939 Gammeter ..... 493/194
2,235,963 A * 3/1941 McGirr et al. ..... 229/5.6
2,240,599 A * 5/1941 Amberg ..... 229/400
4,324,338 A * 4/1982 Beall ..... 215/6
4,574,987 A * 3/1986 Halligan et al. ..... 222/107
4,775,523 A * 10/1988 Sparacio et al. ..... 424/49
4,813,862 A * 3/1989 Bowers et al. ..... 425/87
4,863,014 A * 9/1989 Summons et al. ..... 222/107
5,395,005 A * 3/1995 Yoshida ..... 220/359.2
5,913,449 A * 6/1999 Branch et al. ..... 220/677
6,210,766 B1 * 4/2001 McLaughlin ..... 428/35.7
6,648,176 B1 * 11/2003 Donovan ..... 222/107

FOREIGN PATENT DOCUMENTS

EP 0 074 936 3/1983
JP 56-156777 11/1981

* cited by examiner

*Primary Examiner* — Anthony Stashick
*Assistant Examiner* — Harry A Grosso
(74) *Attorney, Agent, or Firm* — Fish & Richardson P.C.

(57) ABSTRACT

A collapsible container for receiving food has a flexible wall that includes at least two layers. The container has a withdrawal opening with a bent opening edge and is closed at its end opposite the withdrawal opening. The container is rolled from a two-dimensional blank which is connected with itself in an overlap region extending in particular in the longitudinal direction of the container by heat and/or pressure. An inspection of the interior of the container is possible, since the container is formed from a transparent and liquid tight material which can be shaped for bending the opening edge and is dimensionally stable after the shaping. A blank for the manufacture of such a collapsible container is provided.

32 Claims, 3 Drawing Sheets

COLLAPSIBLE CONTAINER

FIELD OF THE INVENTION

The invention relates to a collapsible container for receiving food as well as a corresponding blank for manufacturing such a collapsible container.

BACKGROUND OF THE INVENTION

Such a collapsible container is known from the EP 0 074 936 B1. It comprises a tubular body with a wall made of at least two layers. At the upper end, a withdrawal opening serves for filling in the food as well as for consuming the food filled in. At the lower end, the collapsible container is closed. For the manufacture of the container, a two-dimensional blank is used which is first rolled and then connected with itself by heat and/or pressure in an overlap region in particular extending in the longitudinal direction of the container.

The material of the wall is a relatively flexible and relatively stiff material, such as waterproof paper or plastics. One cannot identify from the outside what is filled in the container. Moreover, with the known collapsible container it is necessary, in particular if a paper material is used, to subject the same to an additional stiffening treatment.

From the Japanese Utility Model Publication 56-156777, another collapsible container is known which also serves for receiving food. This collapsible container can, for example, consist of a laminate of stiff paper and of polyethylene applied to both sides thereof. A corresponding lid for the collapsible container consists of a laminate of aluminium foil and polyethylene layers applied on both sides thereof. This collapsible container, too, is opaque and one cannot identify at least optically whether there is anything and what is inside the container.

The object underlying the invention is to improve a collapsible container to facilitate in a simple constructive and inexpensive manner an inspection of the interior of the container while at the same time maintaining all advantages of the known collapsible containers.

SUMMARY OF THE INVENTION

Furthermore, according to the invention, a corresponding blank for the manufacture of such a collapsible container is provided, which, for example, can be used in devices for the manufacture of known collapsible containers and filled analogously to the known collapsible containers.

The collapsible container according to the invention is characterized by the use of a material which combines apparently conflicting properties in an advantageous manner. In order to securely store the food in the collapsible container, the material according to the invention is on the one hand in particular liquid, preferably fluid tight. This prevents both a penetration and a leak of liquid fluids and/or a penetration and a leak of gaseous fluids. In case of dry, in particular pourable food, gastightness can be sufficient in this connection. One can also do without gastightness if the food does not negatively change its properties relevant for the consumption by being contacted with a gas, such as $O_2$ or the like.

Simultaneously, the material is transparent. This results in a number of advantages, for example, that after the manufacture of the collapsible container from the corresponding blank one can simply identify optically whether the interior of the container contains foreign substances and in particular impurities or whether it is damaged. This optical transparency of the collapsible container exists at least in the visible region of the spectrum, the container is, for example, translucent, however, it can also extend to the adjacent spectral regions, i.e. at least towards the infrared and/or ultraviolet region. The optical transparency makes it furthermore possible to monitor in a simple manner the filling degree of the corresponding food when it is filled in. In particular, the filling degree can be monitored from a direction perpendicular to the filling direction.

The transparency of the material furthermore comprises, apart from the advantages of the filling of the collapsible container, a number of advantages for the consumer who wants to take the corresponding food out of the collapsible container or consume it directly therefrom. For the consumer, too, it is important to be able to identify the filling degree of the food in a simple manner. Furthermore, apart from the amount, the consistence of the food filled in can be optically identified in a simple manner. This is analogously true for possible discolourations or colourations of the food. Such discolourations can, for example, permit conclusions as to the freshness of the food, and intended colourations of the food can give an additional optical buying incentive.

Another advantage of the transparency of the material is that during the consumption, one cannot only identify through the withdrawal opening where the food is located relative to the withdrawal opening depending on the exertion of pressure on the collapsible container, but that one can find it out also through the wall of the collapsible container. This, for example, prevents that in case of an ice-cream as food, when tipping or excessively squeezing the collapsible container, already liquefied ice-cream unintentionally exits from the withdrawal opening.

According to the invention, the transparency and liquid and fluid tightness, respectively, of the material is not unfavourably changed by bending the opening edge of the withdrawal opening as the material can be preferably shaped in this connection without changing its properties. With certain materials, even if they are possibly transparent in the beginning, in many cases a so-called crazing occurs in case of such a deformation caused by bending, for example, an opening edge, the crazing normally appearing as a linear whitening of the otherwise transparent material. Such a crazing can also occur in the areas of the wall where a consumer correspondingly exerts a pressure for taking out the food, which can result in buckling or folding lines in this pressure area. Even if such changes of the properties are partly acceptable, for example in the opening edge, they are particularly advantageously avoided.

The collapsible container according to the invention is furthermore characterized by the corresponding material being dimensionally stable after having been shaped. This dimensional stability is, among others, important when the collapsible container is transported between the place of manufacture and the place of filling. Furthermore, when it is filled, the collapsible container remains open even without any additional measures at least in the area of its withdrawal opening due to a corresponding dimensional stability, so that the food can be easily filled in. The dimensional stability is furthermore of assistance when consuming the food, as the collapsible container can be compressed for taking out the food by exerting pressure, on the other hand, however, the collapsible container essentially takes on its original shape without any pressure from the outside, which results in the food being retracted back into the interior of the container until it is again moved towards the withdrawal opening by exerting pressure on the collapsible container from the outside for continuing the consumption. The dimensional stability is also a property which is not to be changed, for example, for maintaining a sufficient stability as well as transparency and tightness also in the overlap region.

In order to be able to employ a corresponding blank for the collapsible container in a simple manner also for devices hitherto employed for similar containers for the manufacture as well as for the filling, the unshaped blank can be even. This makes it possible, on the one hand, to easily stack such a blank for the transport thereof and, on the other hand, to simply draw it into a corresponding device for rolling the blank into the container. In this connection, it is furthermore advantageous for at least the exterior sides of the blank to comprise a certain roughness or basic friction which, for example, prevent a slipping of corresponding draw-in means relatively to the blank.

During the transport of the collapsible container both in an unfilled and an already filled condition and during the provision of the filled collapsible container or its use by a consumer, it is possible for the collapsible container to be contacted by sharp objects. In this connection, it is an advantage for the corresponding material of the wall to comprise a certain mechanical resistance towards such sharp objects, preventing a damage which has a negative influence on either its transparency or fluid tightness.

In order to avoid that during the manufacture of the collapsible container or its later handling in particular in the area of the wall a negative optical impression occurs, two or more layers can be permanently joined in a perfect junction. Otherwise, by a detachment of the layers in some places, there could be the impression of a formation of bubbles or the like, which could, apart from the optical impression, possibly also have a negative influence on the transparency of the material.

In an advantageous embodiment of the collapsible container according to the invention, three layers which are each transparent can be provided for the material. By the choice of the materials for each of the individual layers, depending on the filled in food different demands on the collapsible container can be met. For example, one of the layers can have a heat insulating function for cool or warm food. In order to be able to heat a food within the collapsible container in this connection, the layer materials can also be selected to enable a heating by microwaves.

It is possible that all layers together and due to their interconnection ensure the dimensional stability of the material. In this case, a dimensional stability is, however, always to be understood to the effect that the wall is still flexible enough for moving the food towards the withdrawal opening by exerting an external pressure on the collapsible container.

In another embodiment according to the invention, it is possible that at least one of the layers, in particular the central layer, is an elastic yet dimensionally stable layer. The other layers then do not have to contribute to the dimensional stability in this connection.

It is also possible to achieve the fluid tightness of the material by a layer or by the combined action of a plurality of layers. The latter can be enabled, for example, in that at least one inner layer of the material is liquid tight and/or one of the further layers is gastight.

It is possible that the connection is enabled in the overlap region by heat and/or pressure by a connection means additionally applied to the material of the wall or contained in the material. Such an additional material can be, for example, an adhesive. However, advantageously one dispenses with such an additional material, which can be effected, for example, by the outer and/or inner layer being formed as connection layer at least in the overlap region. That means that the corresponding layer itself serves as connection without any additional means having to be used.

In particular in the overlap region, but also in the region of the withdrawal opening and its opening edge, there sometimes arises a problem in that free ends or edges of the corresponding material are not sufficiently sealed. Thereby, in particular liquid ingredients of the food or liquids located at the outside of the collapsible container, such as condensation water, can penetrate the material. Such a penetration normally changes the thickness of the corresponding material or at least of one layer of the material, such that bubbles occur in the material which have a negative influence on the overall optical appearance. The penetration of such a liquid via the free ends or edges of the layers can also result in the collapsible container becoming altogether leaky or loosing some of its properties, such as its dimensional stability. Such a penetration in particular of liquid can furthermore result in a soaking of the surface of the collapsible container and a detachment of material from the container.

According to the invention, such disadvantages can be prevented by at least edges of the layers being fluid tight.

In order to give the collapsible container an optically more attractive design or for the representation of information, at least one of the layers can be provided with a print.

In both the processing of a corresponding blank for the manufacture of the collapsible container and the later filling or use of the collapsible container by a consumer, it is an advantage if the print is resistant to rubbing.

It has already been indicated above that different materials are possible for the layers, depending on the requirements. One possibility for corresponding materials of the layers can be seen in that in particular the central layer is at least polyester (polyethylene terephthalate (PET)) and the outer and inner layers are coats of lacquers applied to the central layer. The central layer of polyester furthermore meets the requirement of a flexible yet relatively dimensionally stable layer where a bending of the opening edge is possible without the opening edge rolling out again after it has been shaped correspondingly. A corresponding polyester layer is moreover normally liquid tight enough while the applied coats of lacquer can provide the gastightness.

Another possibility for materials of the corresponding layers can be seen in that the layers comprise at least one outer and one inner layer of polypropylene and one central layer of polyester arranged therebetween. The polyester layer comprises the above-mentioned properties, the propylene layers providing the gastightness.

In order to be able to optionally also use prints which are not very resistant to rubbing or to combine a plurality of prints possibly in terms of colour and/or shape, it is possible to provide the print on an inner side of the outer layer and/or an outer side or an inner side of the central layer and/or an outer side of the inner layer. The combination of prints on different layers makes it furthermore possible to optionally form a three-dimensional impression for the print. Such an arrangement of the print avoids a contact with the food filled in the container, so that there is no risk of a negative influence on the food. Naturally, the material of the container, too, is food-neutral.

For being able to provide sufficiently heat in a simple manner for the connection of the blank with itself in the overlap region, at least one of the layers can be ultrasonic absorbent. The absorption of ultrasonics results in the heating of this layer which is at least strong enough for the layer to be sufficiently softened for forming an intimate and in particular fluid tight connection with a layer in contact therewith in the overlap region after a corresponding cooling. This can naturally also be true for both layers in contact in the overlap region, in particular if these are made of the same material.

However, in this connection it should be noted that the heating of the corresponding material by ultrasonics does not result in the transparency of the material being negatively influenced in the overlap region after the connection and the cooling down.

Both for a simplified manufacture of the blank and for ensuring the corresponding properties of the material, it is furthermore favourable for the layers to form a laminate. A large surface of such a laminate can be made of the corresponding layers and a blank can then be punched out of the laminate or prepared in another manner. The use of such a laminate ensures a secure interconnection of the layers, at the same time maintaining the corresponding properties. It is also possible for the layers to be prepared by coextrusion.

If such a collapsible container made of a laminate is to be provided with a corresponding print which is not arranged on its outer or inner side, the print can be printed before the layers are laminated. In this connection, it should be pointed out that the print, too, is protected from fluid by the different layers due to their corresponding fluid tightness, and that thus, for example, no components of the print can leak towards the food or the consumer or that likewise no moisture or the like can penetrate towards the print which could possibly change the optical appearance of the print.

When at least two layers are used for the material, it is also possible for one of the layers to be a laminate.

In order to close the collapsible container in a simple manner at its lower end, this end can be formed by connecting the lower end sections of the wall.

Such a connection can be effected by heat analogously to the one above.

For improving the fluid tightness, it can furthermore prove to be favourable for the lower end sections of the wall to be pressed one to another during the connecting.

The corresponding material can be impact resistant and/or resistant to puncturing, so that a container is not damaged even if it falls down.

For a corresponding cross-section of the cup, various shapes are possible. It is also possible for the cross-section to change along the longitudinal direction of the cup. Possible cross-sections are, for example, circular, approximately polygonal, in particular approximately quadrangular and in particular square, oval, bean-shaped or the like.

It is naturally also possible that the print is not generated directly or at least only by imprinting, for example, colour or the like, but that the print is also pressed into one of the layers, is composed of several prints on different layers or at least sides of the layers or is, for example, a hologram or at least comprises one. This in particular permits a three-dimensional effect of the print. The print can also have a glossy effect for an observer.

The print can also have such a design that it essentially almost covers the complete container wall and only leaves open a control window. Depending on the position of this control window, it can serve for checking the filling degree or the emptied condition of the container. It is naturally also possible for several of such control windows to be left open in the longitudinal direction of the container and/or in the circumferential direction of the container.

Depending on the food filled in, it is furthermore possible for the print to become only visible after at least a part of the food has been taken out. If, for example, the print is of a corresponding white colour and the food also is of this white colour, the print only becomes visible after the filling degree has been lowered down below the print. This is correspondingly true for other colour combinations, where possibly the print can also change its information content in that, for example, further parts of the print only become visible when the food is being emptied.

With respect to the opening edge, a plurality of constructions is possible. It has already been pointed out that the opening edge can be rolled. This rolling can also comprise a multiple rolling round. With an opening edge essentially only radially bent to the outside, the same can be bent to the outside by an angle of 90° or more.

In order to be able to consume, for example, food from the container at any arbitrary location in the circumferential direction of the withdrawal opening, the opening edge advantageously extends along the complete periphery of the withdrawal opening in one embodiment. It is also possible for the opening edge to have a surrounding design only partially and/or in places. For closing the container in the region of the withdrawal opening, a lid can be tightly sealed in particular onto its opening edge.

The container according to the invention can be employed for cooled, uncooled or even heated food. In order not to have to provide advantageously different containers depending on the temperature of the food, the container can be inherently stable at least within a temperature range of −50° C. to +120° C., for example for a sterilization. This in particular relates to the container wall and the corresponding material. It is natural that in this connection just the corresponding properties of the container, such as dimensional stability, shock resistance, impact resistance, transparency etc. are to be maintained over the complete temperature range.

In order to be able to heat, for example, food contained in the container for consuming it, the layers of the container or their material can be permeable to microwaves. This permits a quick and easy heating of the food within the container.

Such a heating can also be an advantage for the sterilization of the container, which can be done before the corresponding food is filled in. With all these proceedings, it is nevertheless ensured that the container does not lose any property, such as gastightness, dimensional stability, transparency or the like.

It should again be pointed out that the corresponding dimensional stability of the container is to be also maintained especially in the connection region or in the overlap region, respectively, or in the region of the opening edge during the shaping, the connection in the overlap region or during a later handling of the container.

In order to be able to store containers according to the invention in a large number in a close space and to simultaneously simply take them out of the container stock, the container can be stackable and unstackable. Such a stackability and unstackability is given, for example, with containers tapered towards the top or bottom.

Some materials for the different layers have already been discussed above. As a summary, it should also be noted that the outer layer of the material is made of polypropylene (PP), oriented PP (coextruded or lacquered), polyethylene (PE), polyethylene terephthalate (PET), lacquered PET, polyamide (PA), lacquered and oriented PA, or the like and/or the inner layer is made of PP, polyvinyl chloride (PVC), polystyrene (PS), PA, PET, or the like.

With the various layers, one of the layers can also have a heat insulating design in order to maintain the low temperature in case of cooled food and the elevated temperature in case of heated food for some time. This can be achieved, for example, by a corresponding material choice at least for one of the layers. Another possibility can be seen in that, for example, one of the layers contains air or in that between two layers air is contained as heat insulator. Such a heat insulating layer also avoids that the consumer has an unpleasant cold or hot feeling at his fingers or hand.

It should be finally noted that the transparency of the material can be a clear transparency, i.e. without any discolouration, it being also possible for a yellow, red, blue, or the like, or even for a multicoloured transparency to be provided.

The blank according to the invention for the manufacture of a collapsible container described above can comprise all properties which have been illustrated in connection with the wall of the collapsible container, the corresponding material and the already described blank.

BRIEF DESCRIPTION OF THE DRAWINGS

In the following, advantageous embodiments of the invention are illustrated more in detail with reference to the figures enclosed in the drawing.

In the drawings.

DETAILED DESCRIPTION

Figure 1:
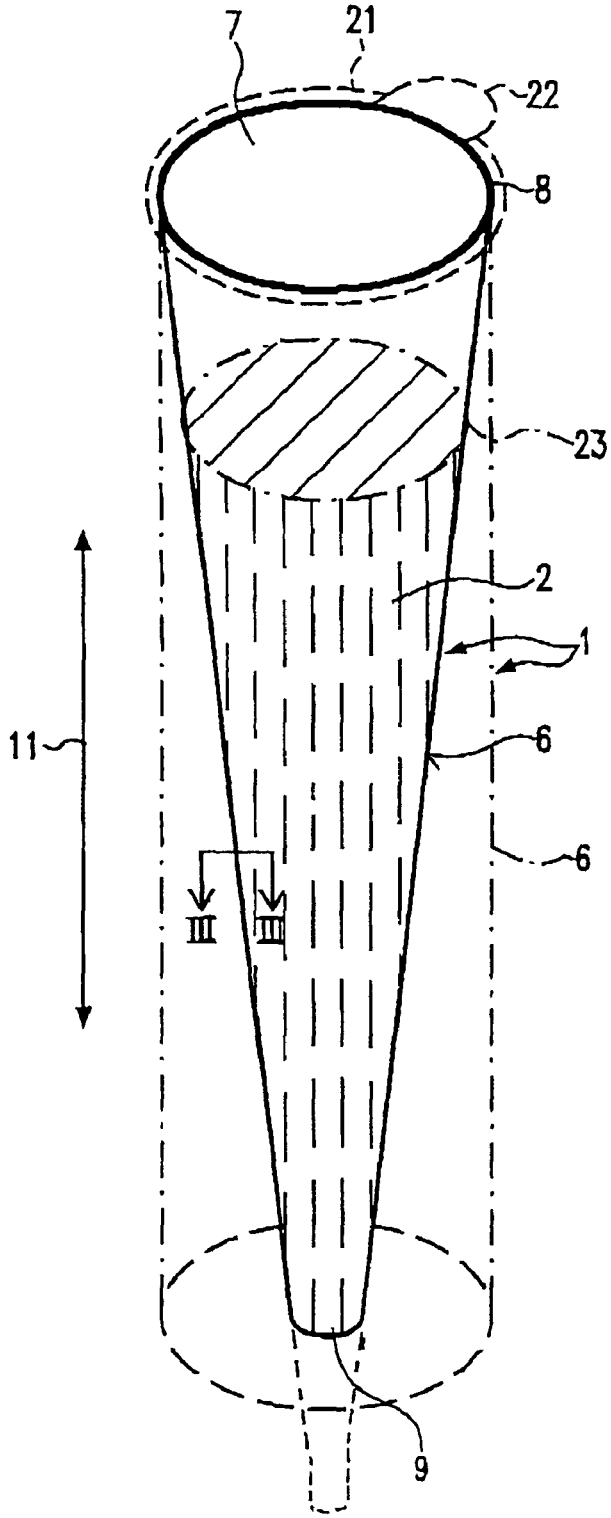
FIG. 1 shows a side view of a collapsible container according to the invention with two embodiments.

FIG. 1 shows a side view of a collapsible container 1 according to the invention for an embodiment tapered towards the lower end 9 and for an essentially tubular embodiment, see the solid line and the double dash-dot line in FIG. 1.

The following illustrations apply to both embodiments, differences resulting only with respect to the lower closed end 9.

The collapsible container 1 contains food 2. It can be taken out by a consumer via an upper withdrawal opening 7. For taking out the food, at least one wall 6 of the collapsible container 1 has to be pressed and heat has to be applied additionally, if necessary. Corresponding heat is necessary if frozen food 2 is contained in the collapsible container 1 which is molten along the contact surface between the food and the wall 6 by heat transmitted by a hand of the user.

Figure 3:
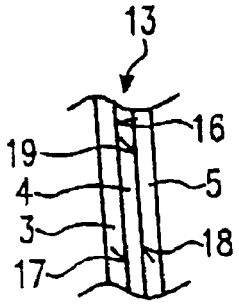
FIG. 3 shows a section along line III-III of FIG. 1.

The wall 6 is flexible and made of at least two layers, also see FIG. 3. The withdrawal opening 7 at the upper end of the collapsible container 1 is circular. It is surrounded by an opening edge 8 which has a bent or rolled cross-section. The opening edge 8 is made of the same material as the wall 6.

A lid 21 can be disposed on the opening edge 8 for closing the withdrawal opening 7. It comprises at least one lid handle 22 radially projecting to the outside. By gripping the lid handle 22, the lid 21 can be drawn off the opening edge 8.

Figure 2:
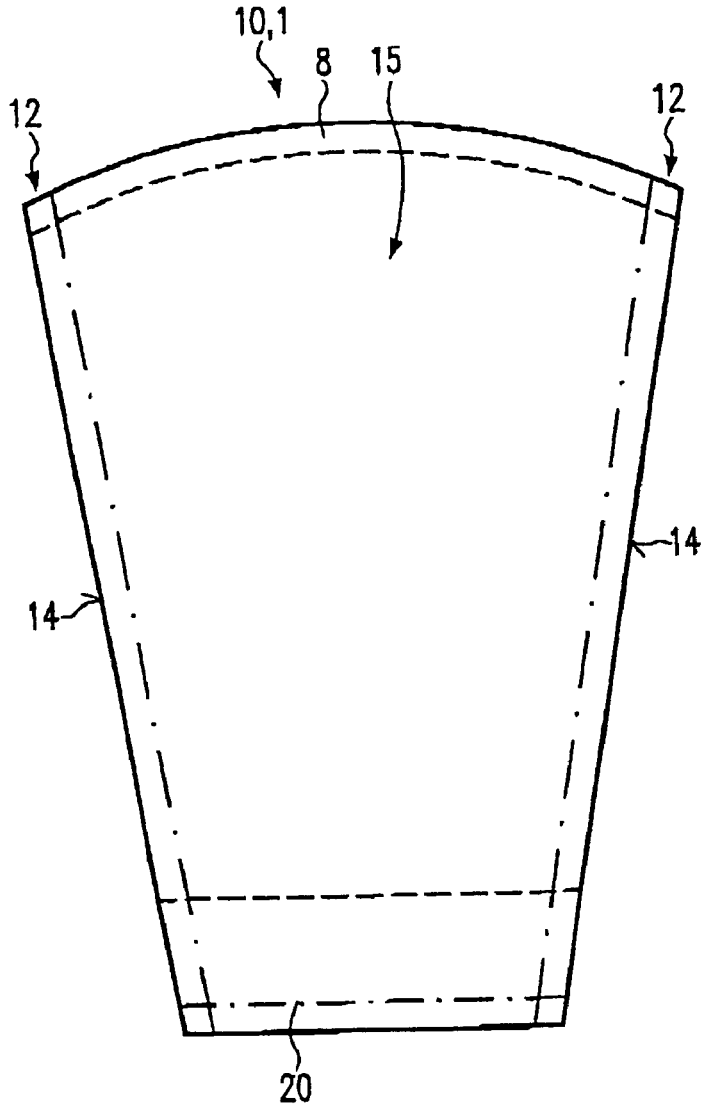
FIG. 2 shows a plan view of a blank for the manufacture of a collapsible container in accordance with FIG. 1.

The collapsible container 1 is prepared from a two-dimensional blank 10, see FIG. 2. The blank 10 is even in an unshaped condition and is rolled round in a corresponding device for forming the collapsible container 1. In the rolled round condition, the outer edges 14 of the blank in FIG. 2 overlap and thus form an overlap region 12. This overlap region essentially extends in the longitudinal direction 11 of the container in the finished collapsible container 1 in accordance with FIG. 1. The connection of the blank in the overlap region 12 with itself is effected by heat and/or pressure.

In FIG. 1, the food 2 can be seen through the wall 6. According to the invention, the wall is made of a transparent and fluid tight material. It is made of at least two layers, see FIG. 3 corresponding to a section along line III-III of FIG. 1.

The edges 14 at the longitudinal sides of the blank 10 and at the corresponding cross sides connecting the longitudinal sides at the top and bottom are fluid tight for preventing a penetration of fluid into the material 13 of the blank 10, see FIG. 3, via the edges and thus into the wall 6 or the collapsible container 1, respectively.

In FIG. 2, along an upper cross side of the blank 10, a region corresponding to the opening edge 8 is indicated which forms the opening edge 8 by rolling or bending round the corresponding section to the outside, see FIG. 1. In the region of the lower cross side of the blank 1 in accordance with FIG. 2, lower end sections 20 which can be connected for closing the lower end 9, see FIG. 1, of the collapsible container 1 are indicated. This connection can be effected, just as the connection in the overlap region 14, by the generation of heat by ultrasonics and by exerting a corresponding pressure.

In FIG. 2, approximately centrically to the blank 10, a print 15 is arranged which is not depicted for simplification in the collapsible container 1 in accordance with FIG. 1. The print 15 can be made in a usual manner also in different colours by printing or the like. The print 15 is resistant to rubbing, so that it is not removed or becomes less legible in the use of the collapsible container 1 due to a contact, for example, with the fingers of the user.

As to the lower end 9 in accordance with FIG. 1, it should be noted that there, too, a handle can be optionally provided which can be formed, for example, by compressing the corresponding lower end sections 20 of the wall 6 and its connection.

As to the lid 21, it should be noted that the same can also be made of a correspondingly transparent and fluid tight material.

In FIG. 3, a section along line III-III through the wall 6 or analogously the blank 10 is shown.

The corresponding material is formed by three layers 3, 4, and 5. One of these layers can be a laminate or prepared by coextrusion or all three layers can form a laminate or be prepared by coextrusion. The layers 3, 4 and 5 are joined in a permanent perfect junction. All three layers are transparent, at least one of the layers, in particular the central layer 4, being not only elastic but also relatively dimensionally stable. At least the inner layer 5 is liquid tight and one of the further layers 3, 4 is gastight. Furthermore, outer and/or inner layers 3, 5 are designed as connection layer at least in the overlap region 14, so that by means of heat and/or pressure a connection of the blank 10 with itself is effected in the overlap region. As a rule, each of the layers 3, 4, 5 comprises the same material composition. Examples of materials for the layer 4 are polyester (PET) and for the layers 3, 5 polypropylene. Another example is the use of polyester for the central layer 4 and the use of coats of lacquer for the outer layer 3 and the inner layer 5. The coats of lacquer can be prepared by coating a corresponding lacquer onto the corresponding sides of the central layer 4.

The print 15 according to FIG. 2 is provided on at least one of the layers. In particular, the print is provided on an inner side 16 of the outer layer 3, on an outer side 17 of the central layer 4, on an inner side 18 of the central layer 4, and/or on an outer side 19 of the inner layer 5. With such an arrangement of the print, the same is printed onto at least one of the layers before the layers 3, 4 and 5 are laminated. As already indicated, it is also possible to compose the print 15 of various individual prints applied onto different layers 3, 4, 5 or to provide various prints 15 at different locations of the blank 10.

The blank 10 according to the invention in accordance with FIG. 2 can correspondingly have other shapes for manufacturing collapsible containers 1 with other shapes, see, for example, the tubular embodiment of the collapsible container 1 in FIG. 1. For the manufacture of a collapsible container, the even, two-dimensional blank 10 in accordance with FIG. 2 is rolled and connected with itself in the overlap region 14 by the action of corresponding heat. The corresponding heat can be generated, for example, by ultrasonics which is absorbed by at least one of the layers 3, 4, 5. Due to the corresponding heat, at least one of the layers is softened enough for forming an intimate connection with the layer in contact therewith in the overlap region 14 after having cooled down. This connection is also fluid tight and transparent. For the manufacture of the bent or rolled round opening edge 8, the corresponding section is then bent or rolled round to the outside in FIG. 1 at the upper end of the blank in accordance with FIG. 2. After the manufacture of the opening edge 8 and the remaining collapsible container 1 from the corresponding material, these are dimensionally stable. Due to the transparency of the corresponding material, not only the filled in food 2, see FIG. 1, is visible, but also its filling degree 23, colouration or discolouration and a print 15 not attached to an outer side of the collapsible container 1. The corresponding material for the blank 10 or the wall 6, respectively, is transparent at least in the visible spectral region, and the transparency can also extend to adjacent spectral regions, such as infrared or ultraviolet.

In the following, a manufacturing process for the collapsible container according to the invention is briefly described by means of the corresponding blank.

First, an outer side, for example, of the central layer, or an inner side, for example, of the outer layer is provided with a print. Subsequently, a laminate is made of the layers, the laminate preferably comprising two, three or more layers, where one of the layers can be laminated. The finished laminate is optionally provided with slots and the blanks are punched out of the laminate. For shaping the corresponding container, the blanks are distributed, rolled, possibly sealed along the edges laterally as well as at the top and the bottom and after the connection of the blank with itself in the overlap region, the opening edge is bent or rolled round. For the transport of the collapsible container prepared in this manner, the same are subsequently fitted into each another.

In the following, the advantages according to the invention are again shortly summarized with respect to consumer-relevant and processing-relevant advantages.

Figure 4:
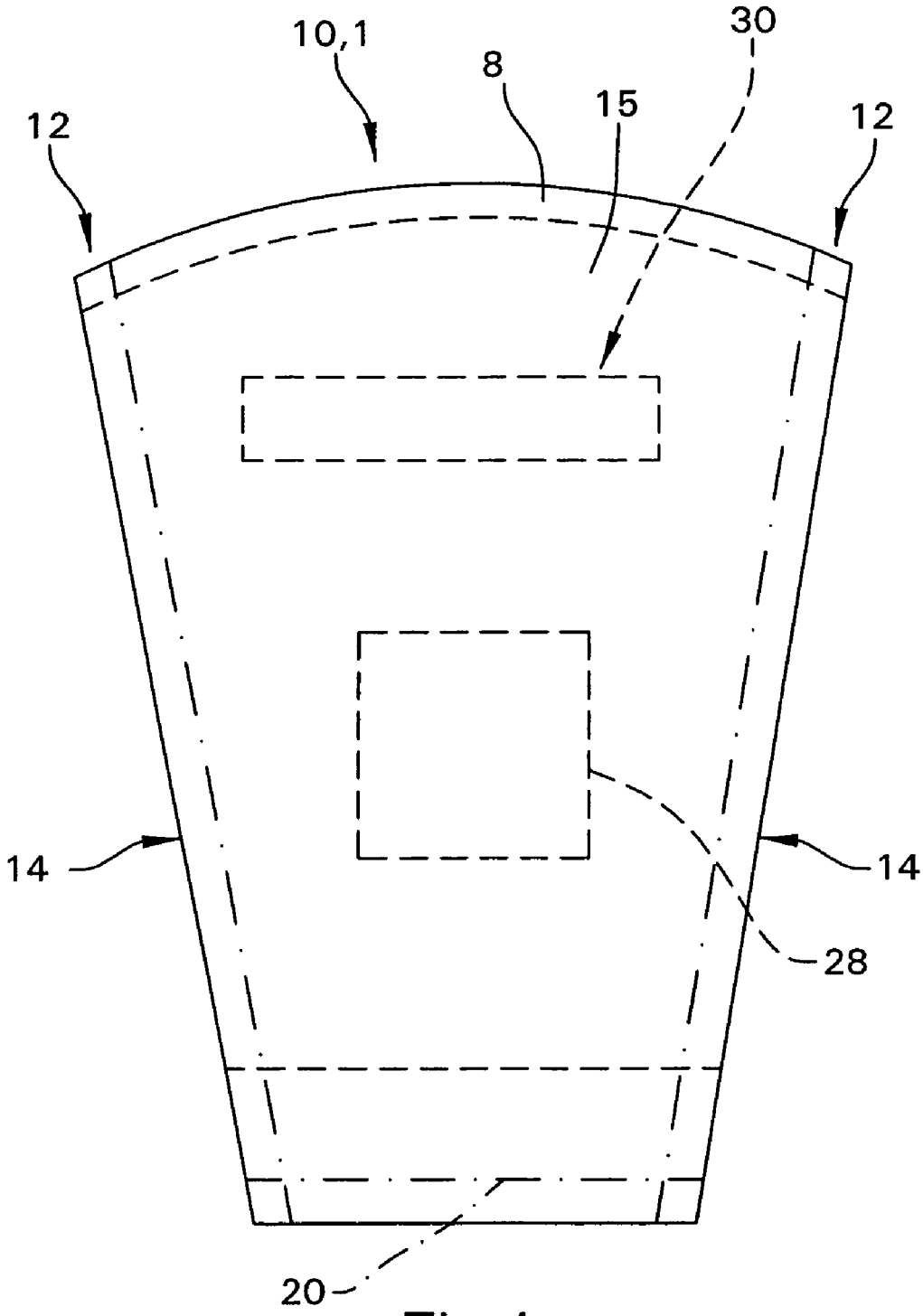
FIG. 4 shows a plan view of a blank including a diagrammatical representation of a hologram and a diagrammatical representation of a window.

One of the consumer-relevant advantages in accordance with the invention is that the corresponding container is characterized by some visual particularities. For example, the container can be prepared in various shapes, such as oval, circular, approximately square or even polygonal as well as bean-shaped and the like. Due to the transparency in particular in the visible spectral region, the contents of the container is moreover also visible without having to open it. Both the filling level and the condition of the food can be checked in a simple manner. The various possibilities of the print result in further visual advantages. The print can also have such a design that there is a glossy effect which particularly emphasizes the print optically. Moreover, the print can have a three-dimensional effect. It is possible to provide the complete container with a print except for at least one window 28 as diagrammatically represented in FIG. 4. The print can be formed by a hologram 30 as diagrammatically represented in FIG. 4 which offers further optical advantages. Moreover, the print can at least partially become visible only after the food has been taken out, which makes it possible, for example, to inform the consumer about a prize he won or the like.

Since the window 28 and hologram 30 are diagrammatical representations with dashed lines, they merely explain, and thus do not constitute actual physical dimensions or a shape for a window or hologram of a container.

The consumer has a number of further functional advantages with the container according to the invention.

One of these advantages is the tightness of the container with respect to gaseous and/or liquid fluids. The tightness relates to both a penetration and a leak of the corresponding fluid. One can also do without a corresponding fluid tightness, if the container is filled with an in particular dry food, of which the properties relevant for the consumption are not negatively influenced, for example, by an exchange of a gaseous fluid through the container wall. That means that this food is not attacked, for example, by oxygen, carbon dioxide or the like and that it is still suitable to be consumed without any restrictions.

Further advantages of the container according to the invention are its flexibility due to which the corresponding food can be pressed out of the container. Simultaneously, the container is nevertheless resistant to external actions in so far as it is impact resistant and shock-proof. That means, if the container falls down it is not damaged and even sharper objects cannot easily push through it.

At the same time, the container is elastic, so that it takes on its original shape even after having been pressed. The tightness of the container is furthermore advantageous as fluid can neither penetrate nor leak.

The resistance of the container also applies to the connection of the individual layers, so that even an only partial detachment of one layer is prevented. Altogether, the container is excellent for storing food, without the properties thereof being negatively influenced by external actions or by materials of the container with respect to the consumption of the food. The dimensional stability of the container is selected such that it is flexible yet automatically takes on its original shape and also maintains its predetermined shape and its other properties in particular in the deformed areas of the container, such as the edge or conglutinated layers.

The print, too, is designed and arranged not to negatively influence the properties of the food or not to be easily removed from the container in any way by rubbing it off or the like. At the same time, the container is made of a material which offers a pleasant feeling to the hand even in case of cooled or heated food.

Apart from this plurality of consumer-relevant advantages, there is a similar number of processing-relevant advantages.

The ease of sealing the container according to the invention during its manufacture is an advantage which is in particular important for the conglutinated parts of the blank. However, the container is tight not only in these conglutinated areas, but also due to the materials of the container. Moreover, the container is appropriate for being imprinted or provided with a print in a simple manner, a number of possibilities for attaching the print onto one or more layers of the material being available.

Due to the even surface of the blank, the same can be easily processed and transported.

In spite of the flexibility of the container material, it can be shaped and maintains its shape in the areas shaped as desired, such as for example in the edge region of the withdrawal opening. This dimensional stability furthermore comes in useful for the joined or conglutinated areas of the container, which also maintain their shape corresponding to the cross-section of the container. This results in a facilitation of the further processing or filling of the container, as the same always maintains its originally intended shape due to its dimensional stability and as, for example, an originally intended circular shape does not change into an oval or even flatter shape in the course of time.

This dimensional stability and a corresponding shaping of the container moreover result in a good stackability and unstackability which is also advantageous in terms of production and transport.

The tightness of the container is important for filling in the corresponding food as both during the filling and the later transport there is no risk of a penetration or leak of a corresponding fluid.

It is furthermore advantageous that the container is resistant both with respect to lower and higher temperatures with respect to its properties and its shape. That means that, for example, food can be filled in and subsequently cooled without the properties being changed, such as tightness, flexibility, dimensional stability, transparency, or the like. This is analogously true for elevated temperatures, which are, for example, advantageous for sterilizing the container. Moreover, correspondingly high temperatures can also occur if the container is used for consuming heated food.

Finally, another processing-relevant advantage is that the container can be easily tightly closed by a lid which can be in particular placed upon the withdrawal opening and tightly connected with the corresponding opening edge.

What is claimed is:

1. Collapsible container for receiving food, having a flexible wall comprising at least two transparent layers, the container comprising a withdrawal opening with a bent opening edge and being closed at its end opposite the withdrawal opening, the container being rolled from a two-dimensional blank which is connected with itself in an overlap region extending in the longitudinal direction of the container by at least one of heat and pressure, wherein the container is formed from a transparent and fluid tight material which can be shaped for bending the opening edge and is dimensionally stable after the shaping, and wherein the container and the material are stable at least within the temperature range of −50° C. to +120° C.

wherein the unshaped blank is two-dimensional to be processed more easily, and wherein the transparency of said container enables filing thereof to be monitored.

2. Collapsible container according to claim 1, wherein two or more of the layers are joined in a permanent perfect junction.

3. Collapsible container according to claim 1, wherein three of said layers are provided, each of which is transparent.

4. Collapsible container according to claim 1, wherein a central one of said layers is an elastic yet permanently ductile layer, and after the shaping, a dimensionally stable layer.

5. Collapsible container according to claim 1, wherein at least an inner one of said layers is liquid tight and a further one of said layers is gastight.

6. Collapsible container according to claim 1, wherein at least one of an outer and an inner one of said layers is formed as a connection layer at least in the overlap region.

7. Collapsible container according to claim 1, wherein edges of the layers are fluid tight.

8. Collapsible container according to claim 1, wherein at least one of the layers is provided with a print.

9. Collapsible container according to claim 1, wherein said layers comprise a central layer made of polyester and outer and inner layers that comprise coats of lacquer applied to the central layer.

10. Collapsible container according to claim 1, wherein the layers comprise an outer layer of polypropylene, an inner layer of polypropylene, and a central layer of polyester arranged therebetween.

11. Collapsible container according to claim 1, wherein the layers comprise an outer layer, an inner layer and a central layer therebetween, and wherein a print is provided on at least one of an inner side of the outer layer, an outer side or an inner side of the central layer, and an outer side of the inner layer.

12. Collapsible container according to claim 1, wherein for the generation of heat for the connection in the overlap region, at least one of the layers is ultrasonic absorbent.

13. Collapsible container according to claim 1, wherein the layers form a laminate.

14. Collapsible container according to claim 1, wherein a print is printed on at least one of the layers before the layers are laminated.

15. Collapsible container according to claim 1, wherein one of the layers is a laminate.

16. Collapsible container according to claim 1, wherein the closed end is formed by connecting lower end sections of the wall.

17. Collapsible container according to claim 16, wherein the lower end sections of the wall are pressed one to another before they are connected.

18. Collapsible container according to claim 1, wherein the container comprises a cup having one of circular, approximately quadrangular, square, oval, bean-shaped and approximately polygonal cross-sections.

19. Collapsible container according to claim 11, wherein the print has a three-dimensional effect.

20. Collapsible container according to claim 11, wherein the print comprises a hologram.

21. Collapsible container according to claim 8, wherein the print leaves open a control window on the wall.

22. Collapsible container according to claim 8, wherein the print is only visible after at least a part of the food is removed.

23. Collapsible container according to claim 1, wherein the opening edge is bent at an angle of 90° or more relative to the rest of the wall.

24. Collapsible container according to claim 1, wherein the container is capable of being stacked and unstacked.

25. Collapsible container according to claim 1, wherein an outer one of said layers of the material is formed from polypropylene (PP), oriented PP (coextruded or lacquered), polyethylene (PE), polyethylene terephthalate (PET), lacquered PET, polyamide (PA), or lacquered and oriented PA and an inner one of said layers is formed from PP, polyvinyl chloride (PVC), polystyrene (PS), PA, or PET.

26. Collapsible container according to claim 1, further comprising an insulating section of air within one of said layers or between said layers to provide an insulating effect.

27. Blank for the manufacture of a collapsible container according to claim 1.

28. A collapsible conical-shaped transparent container for receiving food is made from a blank that is connected to itself in an overlap region by at least one of heat and pressure extending in a longitudinal direction of the container, the container having a withdrawal opening with a bent opening edge at an open end and being closed at an opposing end, the container comprising:

a first liquid impermeable transparent inner layer comprising polypropylene, polyvinyl chloride, polystyrene, polyamide, polyethylene terephthalate, or laminate;

a second elastic and dimensionally stable transparent central layer;

a third gas impermeable transparent outer layer comprising polypropylene, oriented polypropylene, polyethylene, polyethylene terephthalate, lacquered polyethylene terephthalate, polyamide or lacquered and oriented polyamide;

a print provided with one of said layers, said print preventing viewing through said container except for a control window on a section of said container; and a lid for closing the withdrawal opening at the open end of the container and a lid handle projecting outwardly from an edge of said lid and outwardly beyond the bent opening edge of said container to enable removal of said lid and access to the interior of said container;

wherein at least one of the inner layer and the outer layer is formed as a connection layer at least in the overlap region, wherein the closed end is formed by connecting lower sections of the blank, wherein the container has a circular cross-section, wherein the container is capable of being stacked and unstacked with a plurality of similar containers, wherein the transparency of said container enables filing thereof to be monitored from a direction perpendicular to the filling direction and enables optical identification of the food stored therein, and wherein the container is dimensionally stable after having been shaped so that said container is deformable when a force is applied to the outer layer thereof to enable consumption of at least part of the food and so that said container returns to essentially its original shape when the force is removed whereby the food is retracted back into an interior of the container until another force is applied to the outer layer.

29. The collapsible conical-shaped transparent container of claim 28, further comprising an insulating section of air within one of said layers or between two of said layers to provide an insulating effect.

30. Collapsible container for receiving food, having a flexible wall comprising at least two transparent layers, the container comprising a withdrawal opening with a bent opening edge and being closed at its end opposite the withdrawal opening, the container being rolled from a two-dimensional blank which is connected with itself in an overlap region extending in the longitudinal direction of the container by at least one of heat and pressure, wherein the container is formed from a transparent and fluid tight material which can be shaped for bending the opening edge and is dimensionally stable after the shaping, and wherein the container and the material are stable at least within the temperature range of −50° C. to +120° C., wherein three of said layers are provided, each of which is transparent.

31. Collapsible container for receiving food, having a flexible wall comprising at least two transparent layers, the container comprising a withdrawal opening with a bent opening edge and being closed at its end opposite the withdrawal opening, the container being rolled from a two-dimensional blank which is connected with itself in an overlap region extending in the longitudinal direction of the container by at least one of heat and pressure, wherein the container is formed from a transparent and fluid tight material which can be shaped for bending the opening edge and is dimensionally stable after the shaping, and wherein the container and the material are stable at least within the temperature range of −50° C. to +120° C., wherein at least one of the layers is provided with a print, and wherein the print leaves open a control window on the wall.

32. Collapsible container for receiving food, having a flexible wall comprising at least two transparent layers, the container comprising a withdrawal opening with a bent opening edge and being closed at its end opposite the withdrawal opening, the container being rolled from a two-dimensional blank which is connected with itself in an overlap region extending in the longitudinal direction of the container by at least one of heat and pressure, wherein the container is formed from a transparent and fluid tight material which can be shaped for bending the opening edge and is dimensionally stable after the shaping, and wherein the container and the material are stable at least within the temperature range of −50° C. to +120° C., wherein at least one of the layers is provided with a print, and wherein the print is only visible after at least a part of the food is removed.

* * * * *